US010563651B2

(12) United States Patent
Kreidl et al.

(10) Patent No.: US 10,563,651 B2
(45) Date of Patent: Feb. 18, 2020

(54) STATOR FOR AN ECCENTRIC SCREW PUMP, AN ECCENTRIC SCREW PUMP AND A METHOD FOR PRODUCING A STATOR

(71) Applicants: NETZSCH Pumpen & Systeme GmbH, Selb (DE); 3S Schnecken, Spindeln & Spiralen Bearbeitungsges MBH, Roitham (AT)

(72) Inventors: Johann Kreidl, Waldkraiburg (DE); Walter Reisinger, Roitham (AT)

(73) Assignees: NETZSCH Pumpen & Systeme GmbH, Selb (DE); 3S Schnecken, Spindeln & Spiralen Bearbeitungsges m.b.H., Roitham (AT)

( * ) Notice: Subject to any disclaimer, the term of this patent is extended or adjusted under 35 U.S.C. 154(b) by 195 days.

(21) Appl. No.: 15/512,004

(22) PCT Filed: Aug. 4, 2015

(86) PCT No.: PCT/EP2015/067936
§ 371 (c)(1),
(2) Date: Mar. 16, 2017

(87) PCT Pub. No.: WO2016/041686
PCT Pub. Date: Mar. 24, 2016

(65) Prior Publication Data

US 2017/0254327 A1 Sep. 7, 2017

(30) Foreign Application Priority Data

Sep. 16, 2014 (EP) ..... 14184955

(51) Int. Cl.
*F01C 1/10* (2006.01)
*F03C 2/00* (2006.01)
(Continued)

(52) U.S. Cl.
CPC ..... *F04C 2/1075* (2013.01); *F04C 2/1071* (2013.01); *F04C 15/0065* (2013.01);
(Continued)

(58) Field of Classification Search
CPC ..... F04C 2/08; F04C 2/1071; F04C 2/1075; F04C 15/0065; F04C 15/0057; F04C 2230/60; F04C 2240/102; F04C 2240/30
(Continued)

(56) References Cited

U.S. PATENT DOCUMENTS 6,082,980 A 7/2000 Papin
2006/0182644 A1 8/2006 Delpassand et al.
(Continued)

FOREIGN PATENT DOCUMENTS

DE 3902740 A1 8/1998

OTHER PUBLICATIONS

German International Search Report & Written Opinion Application No. PCT/EP2015/067936 Completed Date: Aug. 18, 2015; dated Aug. 26, 2015 9 Pages.
(Continued)

*Primary Examiner* — Theresa Trieu
(74) *Attorney, Agent, or Firm* — Whitmyer IP Group LLC

(57) ABSTRACT

A stator for an eccentric screw pump with an internal hollow space with a helically coiled inner contour for accommodating a rotor. The stator includes a stator core arranged in a stator casing, which stator core includes at least two radially separable core parts. According to the invention, the at least two radially separable core parts are each made from a metallic material or a technical ceramic material. The stator casing is a stator tube and is made of a metallic material. The stator casing is shrink-fitted onto the stator core. The invention also relates to an eccentric screw pump and a method for producing a stator.

19 Claims, 3 Drawing Sheets

(51) Int. Cl.

| | |
|---|---|
| ***F03C 4/00*** | (2006.01) |
| ***F04C 18/00*** | (2006.01) |
| ***F04C 2/00*** | (2006.01) |
| ***F04C 2/107*** | (2006.01) |
| ***F04C 15/00*** | (2006.01) |
| *F04C 2/08* | (2006.01) |

(52) U.S. Cl.
CPC ..... *F04C 2/08* (2013.01); *F04C 15/0057* (2013.01); *F04C 2230/60* (2013.01); *F04C 2240/102* (2013.01); *F04C 2240/30* (2013.01)

(58) Field of Classification Search
USPC ..... 418/1, 48, 152, 178–179; 29/888.023
See application file for complete search history.

(56) References Cited

U.S. PATENT DOCUMENTS

| | | | |
|---|---|---|---|
| 2009/0110578 | A1 | 4/2009 | Amburgey et al. |
| 2009/0110579 | A1 | 4/2009 | Amburgey |

OTHER PUBLICATIONS

English Translation of International Search Report Application No. PCT/EP2015/067936 Completed Date: Aug. 18, 2015; dated Aug. 26, 2015 2 Pages.

I

II

III 3
2
- Q1
T = T(U)
2T(1)
T = T(1) < T(U)
+ Q2
4
T = T(U)
4T(2)
T = T(2) > T(U)
T = T(1) < T(U)
2
4
T = T(2) > T(U)
T = T(U)
1

STATOR FOR AN ECCENTRIC SCREW PUMP, AN ECCENTRIC SCREW PUMP AND A METHOD FOR PRODUCING A STATOR

TECHNICAL FIELD

The present invention relates to a stator for an eccentric screw pump, an eccentric screw pump and a method for producing a stator according to the features of the invention.

BACKGROUND

Eccentric screw pumps are pumps for delivering a plurality of media, in particular viscous, highly viscous and abrasive media such as for example sludges, manure, crude oil and greases. Eccentric screw pumps known from the prior art comprise a rotor and a stator, wherein the rotor is accommodated in the stator and moves eccentrically in the stator. The stator is constituted by a housing with a helically coiled inner side. As a result of the motion of the rotor and mutual contact, meandering delivery spaces are formed between stator and rotor, by means of which liquid media can be transported along the stator. The rotor performs an eccentric rotary motion around the stator axis or around the longitudinal axis of the eccentric screw pump. The outer screw, i.e. the stator, has the form of a double thread in the most common embodiment, whilst the rotor screw in this case is only single thread. Multiple thread embodiments function according to the same kinematic principle. Eccentric screw pumps are suitable for example for the delivery of water, crude oil and a plurality of other liquids. The shape of the delivery spaces is constant during the motion of the rotor inside the stator, so that the delivered medium is not squashed. With a suitable design, not only fluids but also solids can be delivered with eccentric screw pumps.

The rotor is usually made of a highly abrasion-resistant material such as steel for example. The stator, on the other hand, is made from an elastic material, rubber for example, for many applications. For many applications, the elastomer is vulcanised in a tubular metal housing referred to as a stator casing.

Pumps constituted in this way work completely satisfactorily in applications in which temperatures of 140° C. are not exceeded. At higher temperatures, stators made of elastomer can no longer be used. On the one hand, the elastomer material does not withstand these temperatures. On the other hand, the different expansion coefficients of steel and elastomer require rotors with an undersize, i.e. the maximum outer diameter of the rotor is less than the inner diameter of the stator. The rotor is thus not held too firmly in the stator and the pump can thus always operate properly.

In order to overcome these drawbacks, U.S. Pat. No. 6,082,980 describes an eccentric screw pump wherein rotor and stator are each made of materials which have thermal expansion coefficients such that the temperature changes in a temperature range between 5° C. and 300° C. always bring about corresponding material expansions on stator and rotor, a largely constant spacing between the rotor and the stator being maintained.

For many applications, stators are preferred which have the shape of a cylindrical outer lateral surface. A production operation similar to the production of an elastomer core with the shape of a cylindrical outer lateral surface, which is then pushed into a steel casing or suchlike and glued or otherwise fixed, is conceivable. Furthermore, US 2009/0110578 A1 describes a split stator, which comprises at least two radially separable stator parts. If one of these stator parts is removed, the rotor arranged in the stator and/or the interior space of the stator is then at least partially accessible.

DE 3902740 C2 describes the production of a stator by means of a metal-cutting operation. Sub-segments of the inner-hole profile of the stator to be formed are each produced on rod-like blanks as outer machining surfaces by means of a standard metal-cutting operation. The blanks are then split up in the direction of their longitudinal axes into a predetermined number of sections, in such a way that each section comprises a sub-segment of the inner-hole profile, and these sections are then assembled together in such a way that the sub-segments complement one another to form the complete inner-hole profile of the stator.

The problem of the invention is to provide a stator for an eccentric screw pump and an eccentric screw pump with a stator, wherein the stator comprises a stator core made of a first temperature-resistant material and is fixed in a stator casing.

The above problem is solved by a stator for an eccentric screw pump, an eccentric screw pump and a method for producing a stator, which comprise the features described in the independent claims. Further advantageous embodiments are described by the sub-claims.

SUMMARY

The invention relates to a stator for an eccentric screw pump and an eccentric screw pump with a corresponding stator. The stator comprises an internal hollow space with a helically coiled inner contour for accommodating a rotor. During the operation of the eccentric screw pump, meandering delivery spaces for the transport of material to be delivered are formed by the movement of the rotor in the internal hollow space of the stator between the rotor and the inner contour of the stator.

The stator comprises a stator core arranged in a stator casing. The stator core comprises at least two radially separable core parts.

According to the invention, the at least two radially separable core parts are each made from a metallic material or a technical ceramic material, i.e. from a material which possesses material-resistance even in a higher temperature range, for example at temperatures around 300° C., and enables a reliable operation of an eccentric screw pump with such a stator. Technical ceramic refers to ceramic materials which have been optimised in their properties for technical applications. It differs from ceramics used for decorative purposes or hollow ware, tiles or sanitary objects, amongst others, by the purity and the more narrowly tolerated grain size of its starting materials and often by special firing processes. Depending on the method of production, technical ceramics can have very different material properties.

The stator casing is constituted by a stator tube made of a metallic material and is shrink-fitted onto the stator core. In particular, fixing of the stator casing on the stator core takes place without the use of an adhesive or suchlike.

According to a preferred embodiment of the invention, the core parts each comprise a partial inner contour. In the combined stator core, the partial inner contours of the at least two core parts form the inner contour of the stator core. The duly constituted partial inner contour is introduced into the respective core part preferably by multiaxial profile milling or another suitable method, in such a way that the core parts assembled to form the stator core constitute the inner contour of the stator core.

The stator core is preferably split in a plane containing the central stator longitudinal axis, i.e. the stator core is formed by two core parts of equal size.

According to a further embodiment of the invention, at least one first core part comprises at least one positioning pin on a contact face with respect to the at least one second core part. Furthermore, the at least one second core part comprises at least one corresponding recess for receiving the positioning pin at a corresponding position of a contact face with respect to the at least one first core part. These positioning means serve in particular to ensure that the partial inner contours of the core parts are assigned to one another in such a way that the inner contour of the stator core is formed. It is important here that at the contact regions the partial inner contours adjoin one another in such a way that no mutual offset of the partial inner contours is formed that would interfere with the movement of the rotor. In particular, the at least two core parts are joined together in such a way that the at least one positioning pin of the at least one first core part engages in a form-fit manner with the least possible play in the at least one corresponding recess of the at least one second core part.

According to an embodiment of the invention, the stator core composed of at least two core parts, before the shrinking-on of the stator casing at an ambient temperature in a temperature range between 5° C. and 25° C., has in a region of an outer lateral surface an outer circumference which is slightly greater than the inner circumference of the stator casing at the aforementioned ambient temperature.

Furthermore, the invention relates to a method for producing a stator described above. The latter is produced from a stator core made of a metallic material or a technical ceramic material and a stator casing made of a metallic material. A stator tube forming the stator casing is shrink-fitted onto the stator core, i.e. the fixing of the stator core in the stator casing requires no additional jointing and/or adhesive means.

According to a preferred embodiment of the method, the stator core composed of at least two pinned core parts is cooled to a first temperature. As a result of the cooling of the stator core, the material from which the stator core is formed shrinks, so that the outer circumference of the cooled stator core a smaller than the outer circumference of the stator core at normal ambient temperature of approx. 5° C. to 25° C. In particular, the outer circumference of the cooled stator core is smaller than the inner circumference of the stator casing at an ambient temperature in the stated temperature range. The cooled stator core is pushed into the stator casing, care then being taken to ensure that the radial spacing between the stator core and the stator casing is identical overall. As a result of the temperature equalisation between the stator core and the stator casing and/or as a result of the adaptation of the stator core and the stator casing to the ambient temperature, the stator core is shrink-fitted onto the stator casing.

According to a further embodiment of the method, the stator core comprising at least two assembled core parts is cooled to a first temperature. In parallel with this, the stator casing is heated to a second temperature. The stator casing expands as a result of the heating. In particular the material of the stator casing is selected such that the inner circumference of the stator casing is increased by the heating. The second outer circumference of the cooled stator core is at least slightly smaller than the inner circumference of the heated stator casing. The cooled stator core is pushed into the heated stator casing, care then being taken to ensure that the radial spacing between the cooled stator core and the heated stator casing is identical overall. The stator casing is shrink-fitted onto the stator core as result of the temperature equalisation between the cooled stator core and the heated stator casing and/or by the adaptation of the stator core and the stator casing to the ambient temperature.

The stator core is preferably cooled to a first temperature in a first temperature range between −50° C. and −250° C. For example, the stator core is cooled in liquid nitrogen to a first temperature of approx. −200° C. The stator casing is heated for example to a second temperature in a second temperature range between 35° C. and 150° C.

As an alternative or in addition to the described features, the method can comprise one or more features and/or properties of the previously described device. Alternatively or in addition, the device can also comprise individual ones or a plurality of features and/or properties of the described method.

The stator according to the invention is particularly well suited for use in eccentric screw pumps for delivering oil, gas or water mixtures at ambient and delivery-medium temperatures of more than 150° C., for example in boreholes or suchlike.

Precise manufacture is enabled as a result of the split embodiment of the stator core. In addition, better levels of efficiency can be achieved with corresponding eccentric screw pumps, since a narrower and more uniform gap between stator and rotor is possible. In addition, the stators made of a metallic material or a technical ceramic have fewer wear problems compared to stators with an elastomer core.

BRIEF DESCRIPTION OF THE DRAWINGS

Examples of embodiment of the invention and its advantages are explained in greater detail below with the aid of the appended figures. The size ratios of the individual elements with respect to one another in the figures do not always correspond to the actual size ratios, since some forms are represented simplified and other forms magnified compared to other elements for the sake of better clarity.

DETAILED DESCRIPTION

Identical reference numbers are used for identical or identically acting elements of the invention. Furthermore, for the sake of clarity, only reference numbers that are required for the description of the given figure are represented in the individual figures. The represented embodiments only represent examples as to how the device according to the invention or the method according to the invention can be constituted and do not represent a conclusive limitation.

Figure 1B:
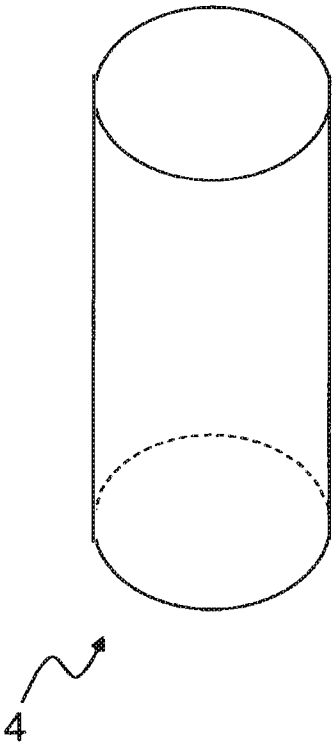
FIGS. 1A and 1B show diagrammatic views of the main components of a stator according to the invention before the assembly of the stator.
Figure 1A:
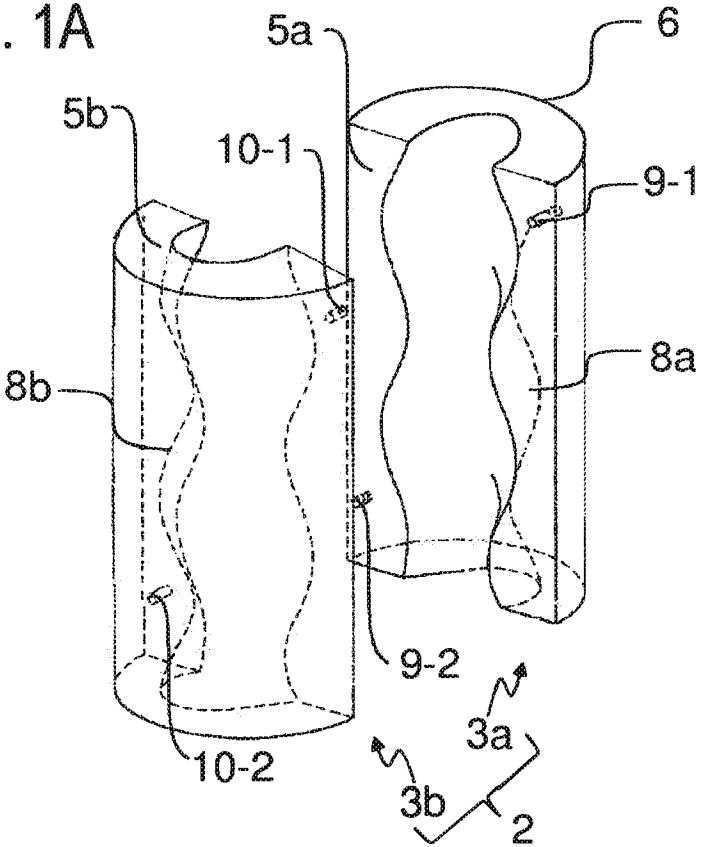
Figure 2:
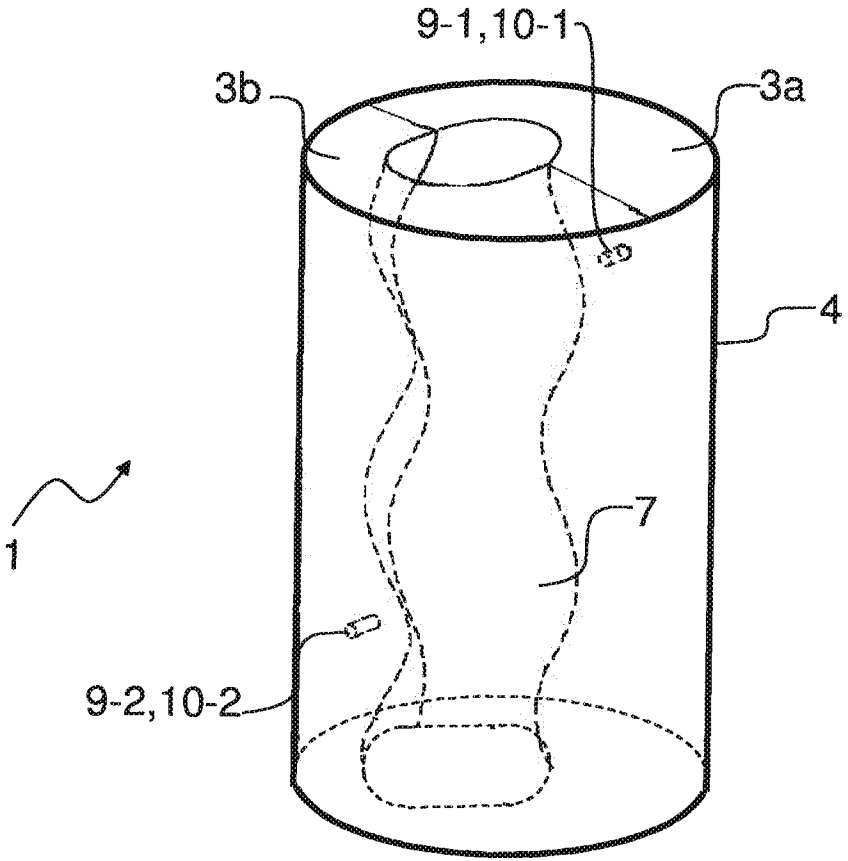
FIG. 2 shows a diagrammatic view of a stator produced according to the invention.

FIGS. 1A and B show diagrammatic views of the main components of a stator 1 according to the invention for the assembly of stator 1 (see FIG. 2) and FIG. 2 shows a diagrammatic view of a stator 1 produced according to the invention. FIG. 1A shows two core parts 3*a*, 3*b* which together form a stator core 2. Stator core 2 comprises an essentially cylindrical outer casing 6. Core parts 3*a*, 3*b* each comprise a partial contour 8*a*, 8*b*, which form the inner contour 7 of stator 1 after assembly of core parts 3*a*, 3*b* (see FIG. 2). Partial contours 8*a*, 8*b* are produced by multiaxial profile milling with high precision. It is important here that the two core parts 3*a*, 3*b* have a common reference point. The one core part 3*a* comprises two alignment pins 9-1, 9-2 at its contact faces 5*a* with respect to second core part 3*b* and second core part 3*b* comprises two pin locators 10-1, 10-2 at corresponding positions of its contact faces 5*b* with respect to first core part 3*a*. The two core parts 3*a*, 3*b* are joined together and pinned in position with one another with the aid of alignment pins 9-1, 9-2 and pin locators 10-1, 10-2.

FIG. 1B shows a stator casing 4, for example a steel tube. Core parts 3*a*, 3*b* are preferably produced oversized, i.e. pinned core parts 3*a*, 3*b* form a stator core 2, which in the unassembled state has an outer circumference which is greater than the inner circumference of tubular stator casing 4.

Figures 3A, 3B, 3C, 3D:
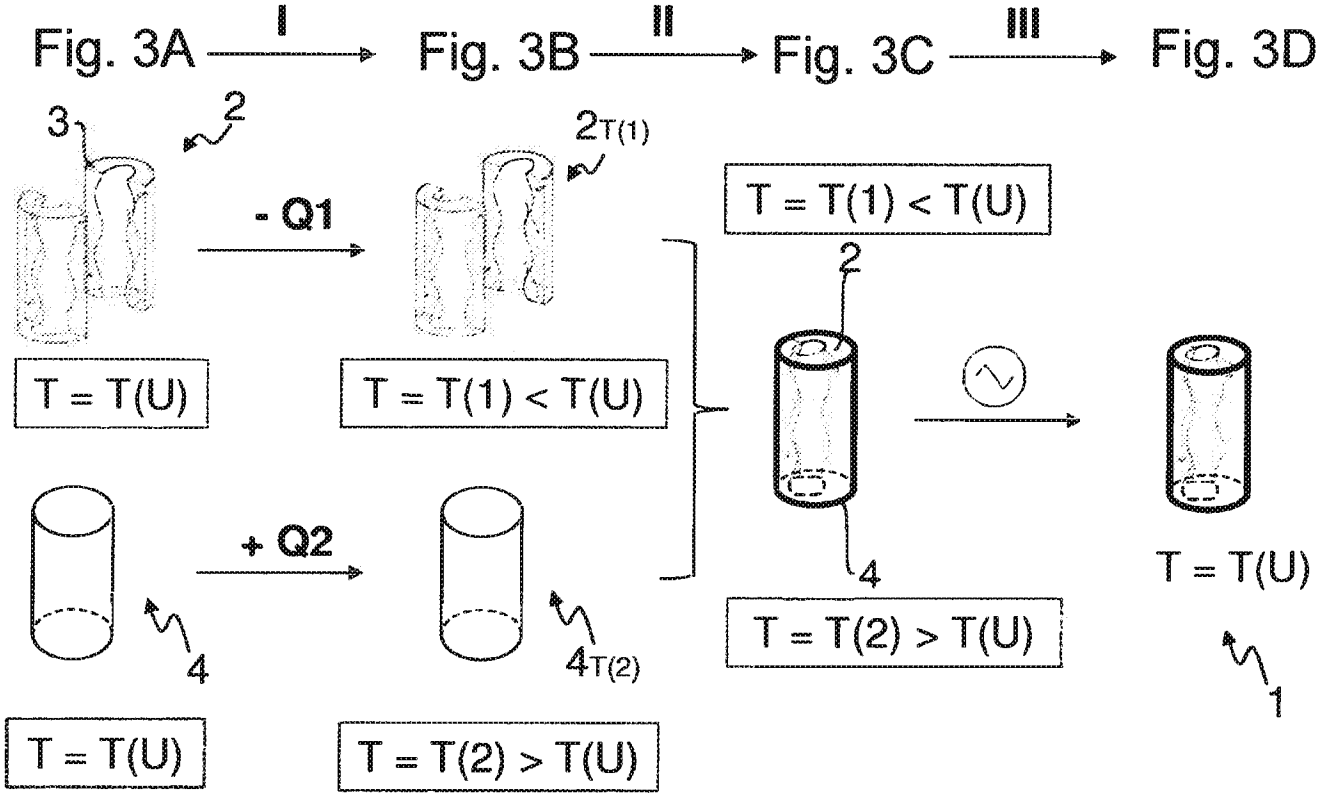
FIGS. 3A, 3B, 3C, and 3D show diagrammatically the process steps for producing a stator according to the invention.

FIG. 3 show diagrammatically the process steps for the production of a stator 1 according to the invention. At the start, the components of the stator, in particular stator core 2 composed of at least two pinned core parts 3 and stator casing 4, have ambient temperature T(U) (see FIG. 3A).

In a first process step I, pinned stator core 2 is cooled, whereby heat Q1 is extracted from the latter, as a result of which the stator core is cooled to a first temperature T(1), which lies below ambient temperature T(U). For example, pinned stator core 2 is cooled to approx. −200° C. by means of liquid nitrogen. As a result of the cooling of stator core 2, the material from which core parts 3 of stator core 2 are formed shrinks, so that the outer circumference of stator core 2T(1) cooled to first temperature T(1) is smaller than the outer circumference of stator core 2 at normal ambient temperature T(U).

In parallel with this, stator casing 4 is heated to a second temperature T(2) by supplying heat Q2. As a result of the heating, stator casing 4 expands. In particular, the material of stator casing 4 is selected such that the inner circumference of stator casing 4 is increased by heating.

In particular, the outer circumference of stator core 2T(1) cooled to first temperature T(1) is smaller than the inner circumference of heated stator casing 4T(2).

In a second process step II, cooled stator core 2T(1) is pushed into stator casing 4T(2) (see FIG. 3B) and positioned, care being taken to ensure that the radial spacing between stator core 2T(1) and stator casing 4T(2) is identical overall.

In a third process step III, a continuous heat exchange between stator core 2 and stator casing 4 leads to a temperature equalisation between stator core 2 and stator casing 4, as a result of which stator casing 4 shrinks onto stator core 2. In stator casing 1 thus produced, a permanently fixed connection is thus produced between stator core 2 and stator casing 4.

This permanently fixed connection is resistant particularly in the event of temperature fluctuations between 15° C. to 300° C. in the ongoing operation of an eccentric screw pump with a stator 1, since no adhesives are used which can spread at high temperatures.

The invention has been described by reference to a preferred embodiment. A person skilled in the art can however imagine that modifications or changes to the invention can be made without thereby departing from the scope of protection of the following claims.

The invention claimed is:

1. A stator for an eccentric screw pump with an internal hollow space with a helically coiled inner contour for accommodating a rotor, wherein the stator comprises a stator core arranged in a stator casing, wherein the stator core comprises at least two radially separable core parts, wherein the at least two radially separable core parts are each made from a metallic material or a technical ceramic material, that the stator casing is constituted by a stator tube made of a metallic material and that the stator casing is shrink-fitted onto the stator core or that the stator core is shrink-fitted into the stator casing.

2. The stator according to claim 1, wherein the core parts each comprise a partial inner contour and wherein the partial inner contours of the at least two core parts in the assembled stator core form the inner contour of the stator core.

3. The stator according to claim 2, wherein at least one first core part comprises at least one positioning pin on a contact face with respect to at least one second core part and wherein the at least one second core part comprises at least one corresponding recess for receiving the positioning pin at a corresponding position of a contact face with respect to the at least one first core part.

4. The stator according to claim 1, wherein at least one first core part comprises at least one positioning pin on a contact face with respect to at least one second core part and wherein the at least one second core part comprises at least one corresponding recess for receiving the positioning pin at a corresponding position of a contact face with respect to the at least one first core part.

5. The stator according to claim 1, wherein the stator core composed of at least two core parts, before the shrinking-on of the stator casing or before the shrink-fitting into the stator casing at an ambient temperature in a temperature range between 5° C. and 25° C., has an outer circumference which is slightly greater than an inner circumference of the stator casing at the ambient temperature in the range between 5° C. and 25° C.

6. An eccentric screw pump comprising a stator with an internal hollow space with a helically coiled inner contour for accommodating a helical rotor, wherein meandering delivery spaces for the transport of material to be delivered are formed by the rotor and the stator during the operation of the eccentric screw pump, wherein the stator comprises a stator core arranged in a stator casing, wherein the stator core comprises at least two radially separable core parts, wherein the at least two radially separable core parts are each made from a metallic material or a technical ceramic material, that the stator casing is constituted by a stator tube made of a metallic material and that the stator casing is shrink-fitted onto the stator core or that the stator core is shrink-fitted into the stator casing.

7. The eccentric screw pump according to claim 6, wherein the core parts each comprise a partial inner contour and wherein the partial inner contours of the at least two core parts in the assembled stator core form the inner contour of the stator core.

8. The eccentric screw pump according to claim 6, wherein at least one first core part comprises at least one positioning pin on a contact face with respect to at least one second core part and wherein the at least one second core part comprises at least one corresponding recess for receiving the positioning pin at a corresponding position of a contact face with respect to the at least one first core part.

9. The eccentric screw pump according to claim 6, wherein the stator core composed of at least two core parts, before the shrinking-on of the stator casing or before the shrink-fitting into the stator casing at an ambient temperature in a temperature range between 5° C. and 25° C., has an outer circumference which is slightly greater than the inner circumference of the stator casing at the ambient temperature in the range between 5° C. and 25° C.

10. A method for producing a stator comprising a stator core arranged in a stator casing, the stator core comprising an internal hollow space with a helically coiled inner contour for accommodating a rotor, wherein the stator core comprises at least two radially separable core parts, wherein the at least two radially separable core parts of the stator core are produced from a metallic material or a technical ceramic material, that the stator casing is produced as a stator tube made from a metallic material and that the stator casing is shrink-fitted onto the stator core or that the stator core is shrink-fitted into the stator casing.

11. The method according to claim 10, wherein the stator core is produced from two core parts, which are split through a plane through a central stator longitudinal axis.

12. The method according to claim 11, wherein a duly constituted partial inner contour is introduced into the respective core parts by multiaxial profile milling, in such a way that the core parts assembled to form the stator core constitute the inner contour of the stator core.

13. The method according to claim 10, wherein a duly constituted partial inner contour is introduced into the respective core parts by multiaxial profile milling, in such a way that the core parts assembled to form the stator core constitute the inner contour of the stator core.

14. The method according to claim 10, wherein at least one positioning pin is provided on at least one first core part on a contact face with respect to at least one second core part and wherein at least one corresponding recess for receiving the positioning pin is formed on at least one second core part at a corresponding position of a contact face with respect to the at least one first core part, wherein the at least two core parts are joined together in such a way that the at least one positioning pin of the at least one first core part engages in the at least one corresponding recess of the at least one second core part.

15. The method according to claim 10, wherein the stator core composed of at least two core parts, before the shrink-fitting into the stator casing, at an ambient temperature in a temperature range between 5° C. and 25° C., has a first outer circumference which is slightly greater than the inner circumference of the stator casing at the ambient temperature in the range between 5° C. and 25° C., wherein the stator core composed of at least two core parts is cooled to a first temperature, wherein the cooled stator core at the first temperature has a second outer circumference which is slightly smaller than the inner circumference of the stator casing, wherein the cooled stator core is pushed into the stator casing, so that the radial spacing between the cooled stator core and the stator casing is identical overall, wherein the stator core is shrink-fitted into the stator casing by a temperature equalization between the stator core and the stator casing and/or by adaptation to the ambient temperature.

16. The method according to claim 15, wherein the stator core is cooled to the first temperature in a first temperature range between −50° C. and −250° C. and/or wherein the stator casing is heated to a second temperature in a second temperature range between 35° C. and 150° C.

17. The method according to claim 15, wherein the stator core is cooled with liquid nitrogen to the first temperature of approx. −200° C.

18. The method according to claim 10, wherein the stator core composed of at least two core parts, before the shrinking-on of the stator casing at an ambient temperature in a temperature range between 5° C. and 25° C., has a first outer circumference which is slightly greater than the inner circumference of the stator casing at the ambient temperature in the range between 5° C. and 25° C., wherein the stator core composed of at least two core parts is cooled to a first temperature, and wherein the stator casing is heated to a second temperature, wherein the cooled stator core at the first temperature has a second outer circumference which is slightly smaller than the inner circumference of the heated stator casing, wherein the cooled stator core is pushed into the heated stator casing, so that the radial spacing between the cooled stator core and the heated stator casing is identical overall, wherein the stator casing is shrink-fitted onto the stator core by a temperature equalization between the stator core and the stator casing and/or by cooling to the ambient temperature.

19. The method according to claim 18, wherein the stator core is cooled to the first temperature in a first temperature range between −50° C. and −250° C. and/or wherein the stator casing is heated to the second temperature in a second temperature range between 35° C. and 150° C.

* * * * *